US009144806B2

(12) United States Patent
Chen et al.

(10) Patent No.: US 9,144,806 B2
(45) Date of Patent: Sep. 29, 2015

(54) OPTICALLY-INDUCED DIELECTROPHORESIS DEVICE

(71) Applicant: Industrial Technology Research Institute, Hsinchu (TW)

(72) Inventors: Hsiu-Hsiang Chen, Hsinchu County (TW); Hsin-Hsiang Lo, Hsinchu County (TW); Chun-Chuan Lin, Hsinchu (TW); Chi-Shen Chang, Hsinchu County (TW); Jyh-Chern Chen, New Taipei (TW); Kuo-Tung Tiao, Hsinchu County (TW); Kuo-Yao Weng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 46 days.

(21) Appl. No.: 13/935,494

(22) Filed: Jul. 4, 2013

(65) Prior Publication Data

US 2014/0008230 A1 Jan. 9, 2014

Related U.S. Application Data

(60) Provisional application No. 61/668,022, filed on Jul. 4, 2012.

(51) Int. Cl.
*B03C 5/02* (2006.01)
*B03C 5/00* (2006.01)

(52) U.S. Cl.
CPC ..... *B03C 5/024* (2013.01); *B03C 5/005* (2013.01); *B03C 2201/26* (2013.01)

(58) Field of Classification Search
CPC ..... C03C 5/005; C03C 5/024
USPC ..... 204/547, 643
See application file for complete search history.

(56) References Cited

U.S. PATENT DOCUMENTS 7,612,355 B2 11/2009 Wu et al.
7,956,339 B2 6/2011 Ohta et al.

(Continued)

FOREIGN PATENT DOCUMENTS

CN 201188104 1/2009
TW 200841009 10/2008

OTHER PUBLICATIONS

Chiou et al., "Massively parallel manipulation of single cells and microparticles using optical images", Nature, Jul. 2005, vol. 436, p. 370-p. 372.

(Continued)

*Primary Examiner* — Keith Hendricks
*Assistant Examiner* — Salil Jain
(74) *Attorney, Agent, or Firm* — Jianq Chyun IP Office

(57) ABSTRACT

An optically-induced dielectrophoresis device includes a first substrate, a first conductive layer, a first patterned photoconductor layer, a first patterned layer, a second substrate, a second conductive layer, and a spacer. The first conductive layer is disposed on the first substrate. The first patterned photoconductor layer is disposed on the first conductive layer. The first patterned layer is disposed on the first conductive layer. The first patterned photoconductor layer and the first patterned layer are distributed alternately over the first conductive layer. Resistivity of the first patterned photoconductor layer is not equal to resistivity of the first patterned layer. At least one of the first substrate and the second substrate is pervious to a light. The second conductive layer is disposed on the second substrate and between the first substrate and the second substrate. The spacer connects the first substrate and the second substrate.

16 Claims, 17 Drawing Sheets

(56) References Cited

U.S. PATENT DOCUMENTS

| | | | | |
|---|---|---|---|---|
| 2010/0051465 | A1 | 3/2010 | Lee et al. | |
| 2010/0101960 | A1 * | 4/2010 | Ohta et al. | 204/643 |

OTHER PUBLICATIONS

Ohta et al., "Dynamic Cell and Microparticle Control via Optoelectronic Tweezerss", Journal of Microelectromechanical Systems, Jun. 2007, vol. 16, p. 491-p. 499.

Park et al., "Floating electrode optoelectronic tweezers: Light-driven dielectrophoretic droplet manipulation in electrically insulating oil medium", Applied Physics Letters, Apr. 2008, vol. 92, p. 151101-1-p. 151101-3.

Lau et al., "Antifouling coatings for optoelectronic tweezers", Lab on a Chip, Jul. 2009, vol. 9, p. 2952-p. 2957.

Hsu et al., "Phototransistor-based optoelectronic tweezers for dynamic cell manipulation in cell culture media", Lab on a Chip, Aug. 2009, vol. 10, p. 165-p. 172.

Hwang et al., "Optoelectrofluidic platforms for chemistry and biology", Lab on a Chip, Aug. 2010, vol. 11, p. 33-p. 47.

* cited by examiner

OPTICALLY-INDUCED DIELECTROPHORESIS DEVICE

CROSS-REFERENCE TO RELATED APPLICATION

This application claims the priority benefits of U.S. provisional application Ser. No. 61/668,022, filed on Jul. 4, 2012. The entirety of the above-mentioned patent application is hereby incorporated by reference herein and made a part of this specification.

TECHNICAL FIELD

The disclosure relates to an optically-induced dielectrophoresis device.

BACKGROUND

In the field of biomedical science, it is a key technology to efficiently separate biological cells without damaging them, especially for detecting tumor cells, stem cells, embryos, bacteria, etc. However, the conventional cell control technology, such as optical tweezers, electrophoresis, dielectrophoresis, travelling-wave dielectrophoresis, electrorotation, magnetic tweezers, acoustic traps, and hydrodynamic flows, can not achieve both of high resolution and high flux, wherein although the optical tweezers can achieve high resolution to capture a single particle, it has a control area only about 100 $\mu m^2$. Moreover, the optical tweezers achieve a light intensity of $10^7$ W/cm$^2$, which is easy to cause local overheating, easy to cause cells dead or inactive. As a result, the optical tweezers is not adapted to long-term operation.

In addition, although the electrophoresis and the dielectrophoresis can achieve high flux, they cannot achieve high spatial resolution, and they cannot control a single cell. Moreover, the dielectrophoresis flow field chip generally has a single function, such as a transmission function or a separation function. If different flow fields are required, it is needed to redesign a new photomask and to perform coating, photolithography, and etching to produce fixed electrodes, which costs much and expend much time and effort.

SUMMARY

An optically-induced dielectrophoresis device is introduced herein. The optically-induced dielectrophoresis device comprises a first substrate, a first conductive layer, a first patterned photoconductor layer, a first patterned layer, a second substrate, a second conductive layer, and a spacer. The first conductive layer is disposed on the first substrate. The first patterned photoconductor layer is disposed on the first conductive layer. The first patterned layer is disposed on the first conductive layer. The first patterned photoconductor layer and the first patterned layer are distributed alternately over the first conductive layer. Resistivity of the first patterned photoconductor layer is not equal to resistivity of the first patterned layer. At least one of the first substrate and the second substrate is pervious to a light. The second conductive layer is disposed on the second substrate and between the first substrate and the second substrate. When a voltage difference is generated between the first conductive layer and the second conductive layer and when the light irradiates a part of the first patterned photoconductor layer, conductivity of the part of the first patterned photoconductor layer increases. The spacer connects the first substrate and the second substrate, wherein a containing space is formed between the first substrate and the second substrate.

Another optically-induced dielectrophoresis device is also introduced herein. The optically-induced dielectrophoresis device comprises a first substrate, a first conductive layer, a first photoconductor layer, a first lens array, a second substrate, a second conductive layer, and a spacer. The first substrate is pervious to a first light. The first conductive layer is disposed on the first substrate. The first photoconductor layer is disposed on the first conductive layer. The first lens array is disposed on the first substrate and configured to condense the first light onto the first photoconductor layer. The second conductive layer is disposed on the second substrate and between the first substrate and the second substrate. When a voltage difference is generated between the first conductive layer and the second conductive layer and when the light irradiates a part of the first photoconductor layer, conductivity of the part of the first photoconductor layer increases. The spacer connects the first substrate and the second substrate, wherein a containing space is formed between the first substrate and the second substrate.

Another optically-induced dielectrophoresis device is also introduced herein. The optically-induced dielectrophoresis device comprises a first substrate, a first conductive layer, a first photoconductor layer, a first patterned mask, a second substrate, a second conductive layer, and a spacer. The first substrate is pervious to a first light. The first conductive layer is disposed on the first substrate. The first photoconductor layer is disposed on the first conductive layer. The first patterned mask is disposed on the first substrate and configured to shield a part of the first light. The second conductive layer is disposed on the second substrate and between the first substrate and the second substrate. When a voltage difference is generated between the first conductive layer and the second conductive layer and when another part of the first light passes through the first patterned mask and irradiates a part of the first photoconductor layer, conductivity of the part of the first photoconductor layer increases. The spacer connects the first substrate and the second substrate, wherein a containing space is formed between the first substrate and the second substrate.

Another optically-induced dielectrophoresis device is also introduced herein. The optically-induced dielectrophoresis device comprises a first substrate, a first conductive layer, a first patterned photoconductor layer, a second substrate, a second conductive layer, and a spacer. The first conductive layer is disposed on the first substrate. The first patterned photoconductor layer is disposed on the first conductive layer and is in direct contact with the first conductive layer. At least one of the first substrate and the second substrate is pervious to a light. The second conductive layer is disposed on the second substrate and between the first substrate and the second substrate. When a voltage difference is generated between the first conductive layer and the second conductive layer and when the light irradiates a part of the first patterned photoconductor layer, conductivity of the part of the first patterned photoconductor layer increases. The spacer connects the first substrate and the second substrate, wherein a containing space is formed between the first substrate and the second substrate.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1A:
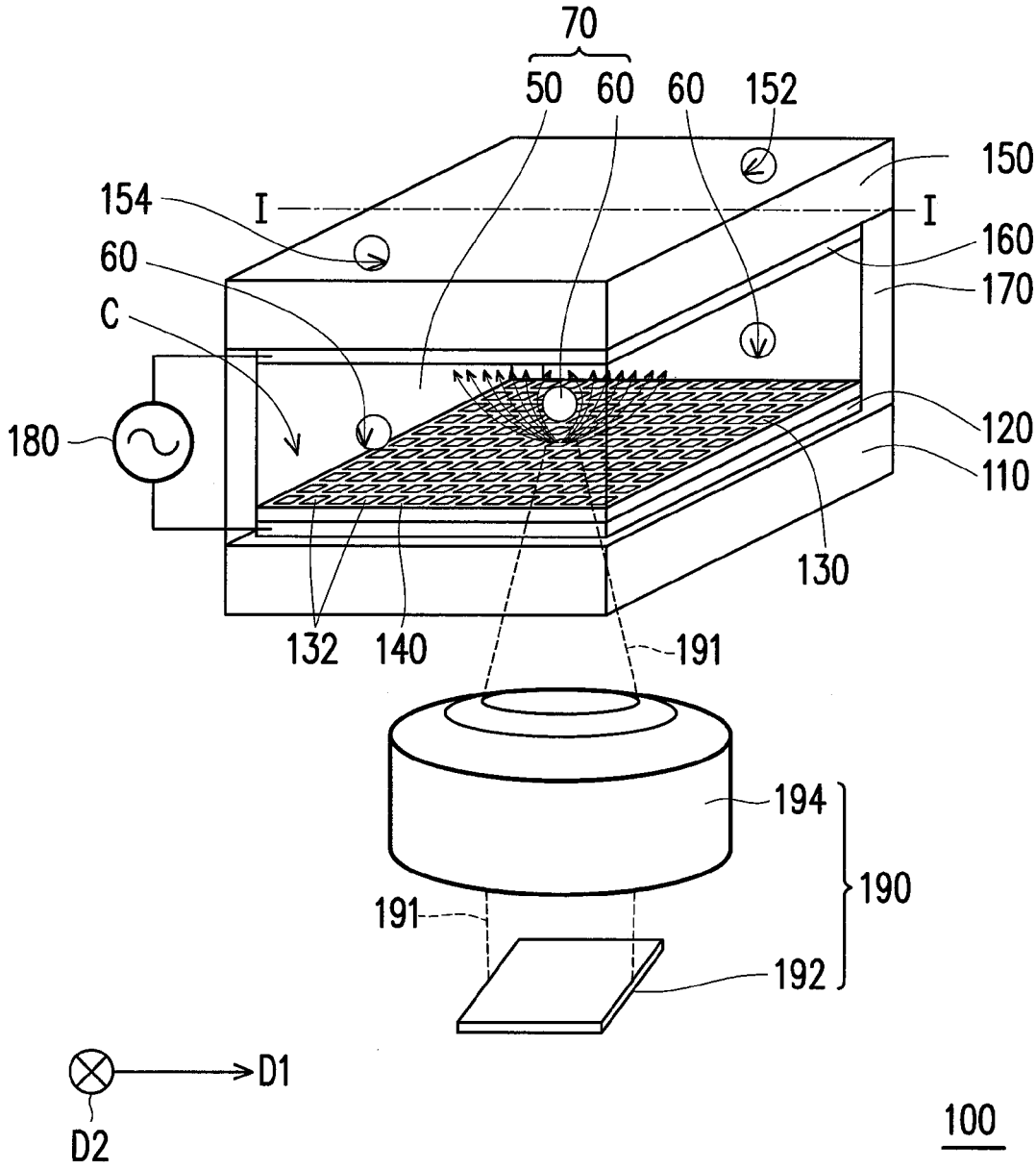
FIG. 1A is schematic perspective view of an optically-induced dielectrophoresis device according to an exemplary embodiment.
Figure 1B:
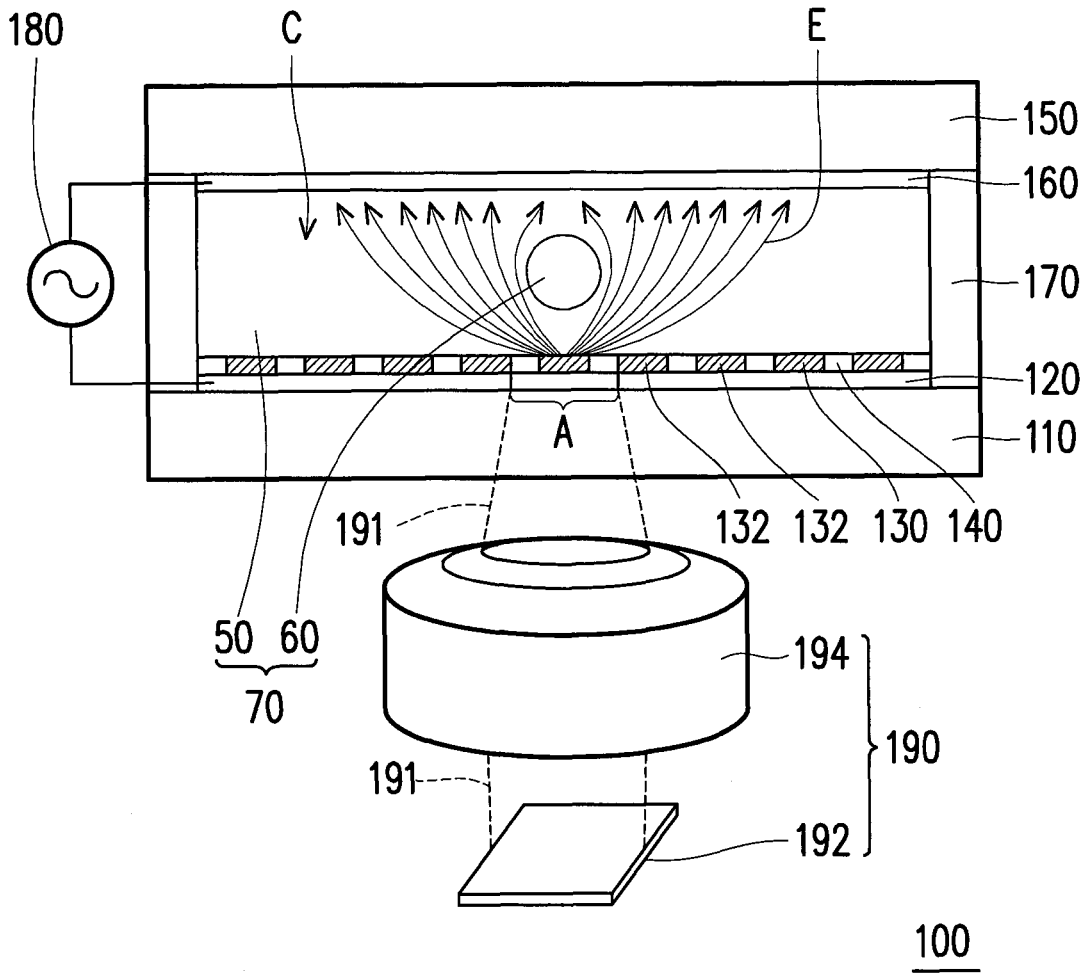
FIG. 1B is a schematic cross-sectional view of the optically-induced dielectrophoresis device according to FIG. 1A.
Figure 1C:
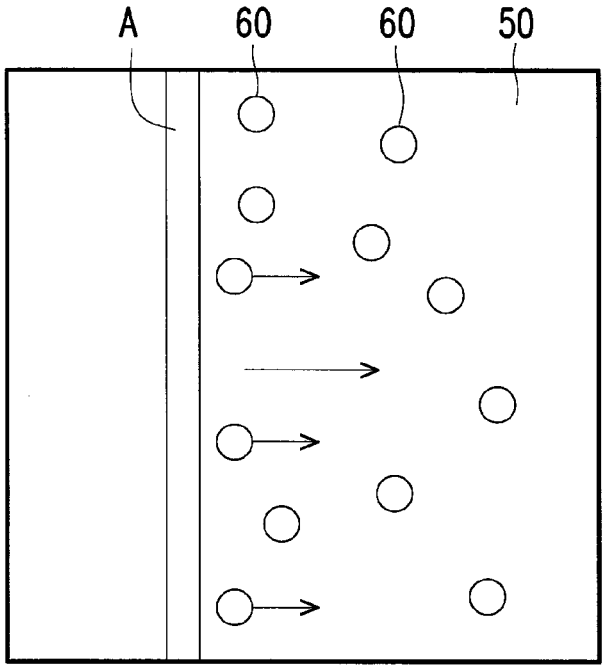
FIG. 1C shows particles are controlled by light in the optically-induced dielectrophoresis device in FIG. 1A.
Figure 1D:
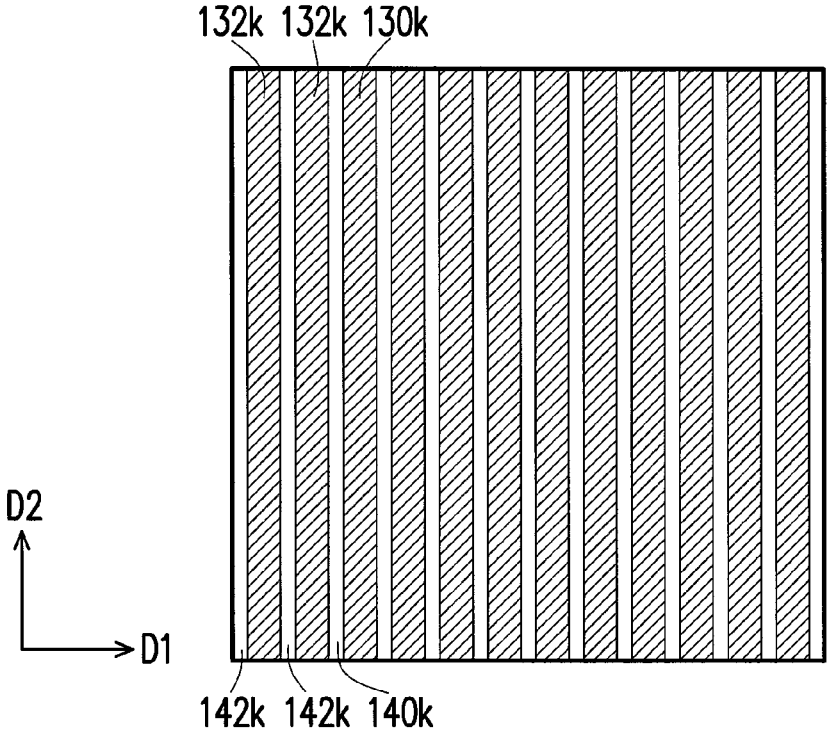
FIG. 1D is a schematic top view of another variation of the first patterned photoconductor layer and the first patterned layer in FIG. 1A.

FIG. 1A is schematic perspective view of an optically-induced dielectrophoresis device according to an exemplary embodiment, FIG. 1B is a schematic cross-sectional view of the optically-induced dielectrophoresis device according to FIG. 1A, FIG. 1C shows particles are controlled by light in the optically-induced dielectrophoresis device in FIG. 1A, and FIG. 1D is a schematic top view of another variation of the first patterned photoconductor layer and the first patterned layer in FIG. 1A. Referring to FIGS. 1A and 1B first, the optically-induced dielectrophoresis device 100 in this embodiment comprises a first substrate 110, a first conductive layer 120, a first patterned photoconductor layer 130, a first patterned layer 140, a second substrate 150, a second conductive layer 160, and a spacer 170. At least one of the first substrate 110 and the second substrate 150 is pervious to a light 191. In this embodiment, the first substrate 110 and the second substrate 150 are, for example, transparent substrates which are pervious to visible light, and the light 191 may be a visible light. However, in other embodiments, the light 191 may be an invisible light, for example, infrared (IR) light or ultraviolet (UV) light. In this embodiment, the first substrate 110 and the second substrate 150 may be glass substrates or plastic substrates.

The first conductive layer 120 is disposed on the first substrate 110. In this embodiment, the first conductive layer 120 is a transparent conductive layer, for example, an indium tin oxide (ITO) layer. The first patterned photoconductor layer 130 is disposed on the first conductive layer 120. In this embodiment, the first patterned photoconductor layer 130 is made of hydrogenated amorphous silicon (a-Si:H), amorphous selenium (a:Se), or any other photoconductive material. Moreover, in one embodiment, the thickness of the first patterned photoconductor layer 130 is greater than or equal to 500 nm and is less than or equal to 2000 nm, so that the first patterned photoconductor layer 130 have good light transmission property and good quality and can generate stronger electrical field E. The first patterned layer 140 is disposed on the first conductive layer 120. In this embodiment, the first patterned layer 140 is an insulation layer. The insulation layer may be made of lithium fluoride or silicon dioxide. The first patterned photoconductor layer 130 and the first patterned layer 140 are distributed alternately over the first conductive layer 120. In this embodiment, the first patterned photoconductor layer 130 comprises a plurality of photoconductor islands 132 separately distributed over the first conductive layer 120, and the first patterned layer 140 is a grid-shaped insulation layer separating the photoconductor islands 132 from each other. The resistivity of the first patterned photoconductor layer 130 is not equal to the resistivity of the first patterned layer 140. In this embodiment, since the first patterned layer 140 is an insulation layer, the resistivity of the first patterned photoconductor layer 130 is less than the resistivity of the first patterned layer 140. The second conductive layer 160 is disposed on the second substrate 150 and between the first substrate 110 and the second substrate 150. In this embodiment, the second conductive layer 160 is a transparent conductive layer, for example, an indium tin oxide (ITO) layer. In this embedment, an adhesive layer (e.g. a buffer layer) may be disposed between the first conductive layer 120 and the first patterned photoconductor layer 130 to improve the quality of the first patterned photoconductor layer 130.

The spacer 170 connects the first substrate 110 and the second substrate 150, and a containing space C is formed between the first substrate 110 and the second substrate 150. In this embodiment, the spacer 170 is a sealant surrounding the containing space and bonding the first substrate 110 and the second substrate 150. In FIG. 1A, the spacer 170 is shown as transparent for the reader to see the inside of the optically-induced dielectrophoresis device 100. However, in this embodiment, the spacer 170 is opaque. In other embodiment, the spacer 170 may be transparent or translucent. In this embodiment, the first substrate 110, the first conductive layer 120, the first patterned photoconductor layer 130, the first patterned layer 140, the second substrate 150, the second conductive layer 160, and the spacer 170 form an optically-induced dielectrophoresis chip.

When a voltage difference is generated between the first conductive layer 120 and the second conductive layer 160 and when the light 191 irradiates a part of the first patterned photoconductor layer 130, the conductivity of the part of the first patterned photoconductor layer 130 increases. Specifically, the optically-induced dielectrophoresis device 100 may further comprises a first projector 190, and the light 191 is an image beam projected from the first projector 190. In this embodiment, the first projector 190 comprises an image source 192 configured to emit the image beam (i.e. the light 191) and a projection lens 194 projecting the image beam onto the first patterned photoconductor layer 130. The image source 192 may comprise a light valve and a illumination system, wherein the illumination system provides an illumination beam irradiating the light valve, and the light valve converts the illumination beam in to the image beam. The light valve may be a digital micro-mirror device (DMD), a liquid crystal on silicon (LCOS), a liquid crystal (LC) panel, or any other spatial light modulator. However, in other embodiments, the image source 192 may be a self-luminescent display panel, for example, a light-emitting diode (LED) display panel or an organic light-emitting diode (OLED) display panel.

In addition, the optically-induced dielectrophoresis device 100 may also have a power source 180 configured to apply a voltage difference between the first conductive layer 120 and the second conductive layer 160. When the light 191 irradiates the region A and when the voltage difference is generated between the first conductive layer 120 and the second conductive layer 160, the conductivity of the part of the first patterned photoconductor layer 130 within the region A increases due to the photoelectric effect. As a result, the electrical field E originated from the first conductive layer 120, penetrating through the patterned photoconductor layer 130, and reaching the containing space C is enhanced. The optically-induced dielectrophoresis device 100 may have an inlet 152 and an outlet 154. The inlet 152 and the outlet 154 penetrate the second substrate 150 and the second conductive layer 160. A sample 70 may be input to the containing space C through the inlet 152. The sample 70 may comprise fluid 50 and particles 60 contained within the fluid 50. In this embodiment, the fluid 50 is a medium, and the particles 60 are cells. Since there is a stronger electrical field E in the portion of the containing space C above the region A, the gradient of the electrical field E around the region A may push the particles 60 (one particle 60 is exemplarily shown in FIGS. 1A and 1B, and a plurality of particles 60 are shown in FIG. 1C) around the region A. The image beam (i.e. the light 191) may be changed by the first projector 190 so as to change the image projected onto the first patterned photoconductor layer 130. As a result, the region A irradiated by the light 191 changes. For example, referring to FIG. 1C, when the region A is changed to move rightwards, the particles 60 near the region A are moved rightwards with the region A. The region A irradiated by the light 191 is exemplarily shown as strip-shaped in FIG. 1C. However, the first projector 190 may change the shape of the region A freely to satisfy various requirements. For example, the region A may be circular-shaped, and the radius of the circle is reduced with time, so that the particles 60 can be aggregated. The shape of region A may be any shape comprising any regular shape or any irregular shape, so the particles 60 may be singly moved or collectively moved. Therefore, the optically-induced dielectrophoresis device can achieve various particle control (e.g. cell control). In other words, the first patterned photoconductor layer 130 serves as a virtual electrode, and the shape of the virtual electrode may be changed freely by the light 191, so as to achieve various particle control.

In this embodiment, since the first patterned photoconductor layer 130 is patterned, e.g., comprising a plurality of separate photoconductor islands 132 by the first patterned layer 140 (i.e. the grid-shaped insulation layer), the electrical field E above the first patterned layer 140 is much smaller than the electrical field E above the first patterned photoconductor layer 130. As a result, the gradient of the electrical field E is enhanced, and the change of the region A irradiated by the light 191 can thus much efficiently control the particles 60 since the larger the gradient, the greater the force applying to the particles 60.

A camera may be disposed beside the second substrate 150 or the first substrate 110 to monitor the particles 60 and the change of the region A, so that the movement of the particles 60 can be controlled well.

In another embodiment, referring to FIG. 1D, the first patterned photoconductor layer 130*k* comprises a plurality of photoconductor strips 132*k*, and the first patterned layer 140*k* comprises a plurality of strip-shaped structures 142*k*. The photoconductor strips 132*k* and the strip-shaped structures 142*k* are arranged alternately along a first direction D1, and the photoconductor strips 132*k* and the strip-shaped structures 142*k* extend along a second direction D2. In this embodiment, the first direction D1 is substantially perpendicular to the second direction D2.

Figure 2:
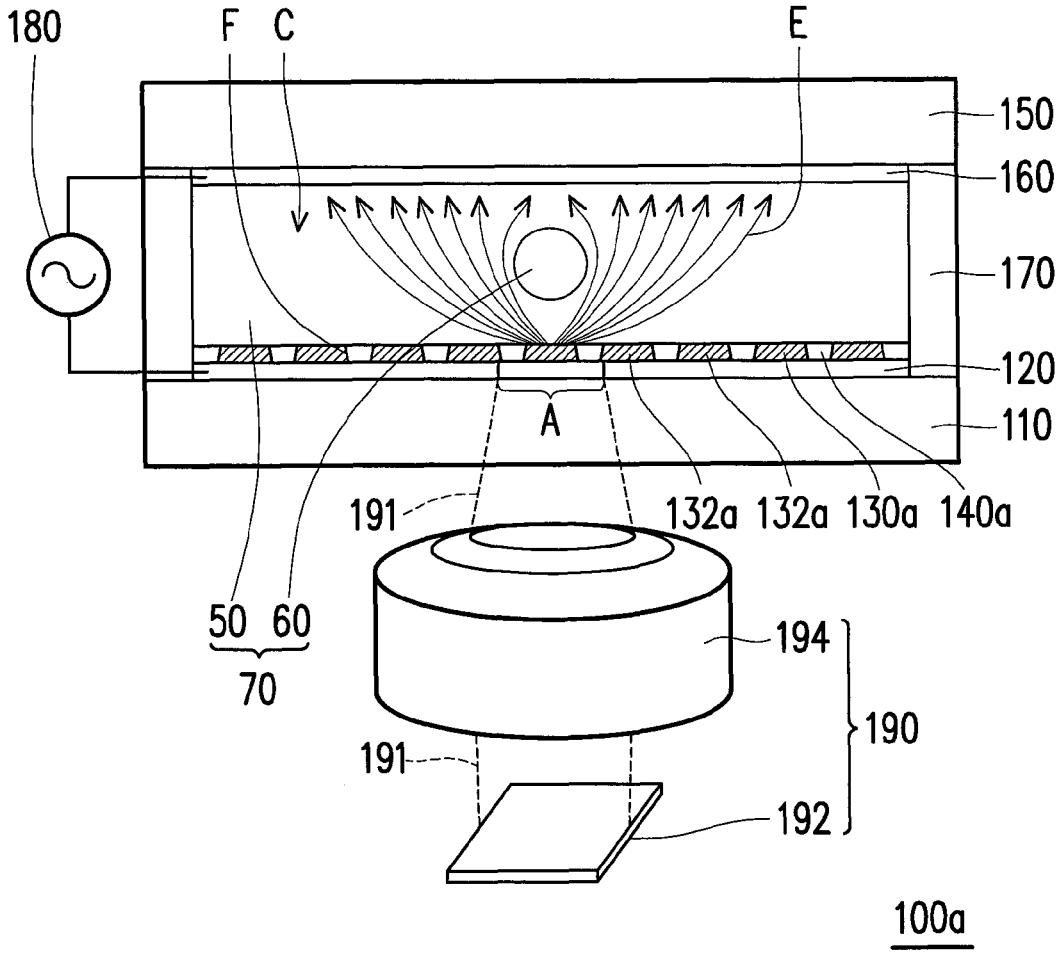
FIG. 2 is a schematic cross-sectional view of an optically-induced dielectrophoresis device according to another exemplary embodiment.

FIG. 2 is a schematic cross-sectional view of an optically-induced dielectrophoresis device according to another exemplary embodiment. Referring to FIG. 2, the optically-induced dielectrophoresis device 100*a* in this embodiment is similar to the optically-induced dielectrophoresis device 100 in FIG. 1B, and the main difference therebetween is as follows. In the optically-induced dielectrophoresis device 100*a*, the interface F of the first patterned photoconductor layer 130*a* and the first patterned layer 140*a* is inclined to the first conductive layer 120. For example, the photoconductor islands 132*a* have inclined side surfaces in this embodiment. However, in FIG. 1B, the photoconductor islands 132 may have vertical side surfaces.

Figure 3:
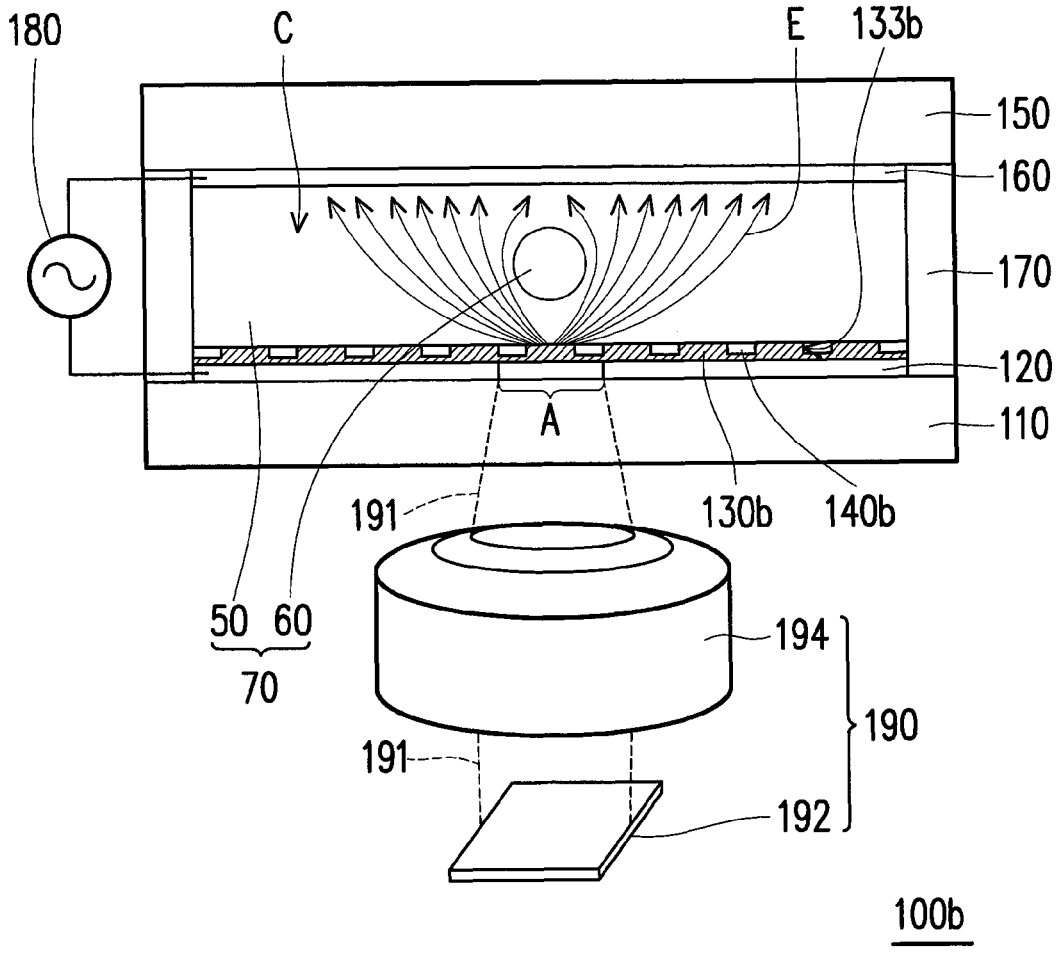
FIG. 3 is a schematic cross-sectional view of an optically-induced dielectrophoresis device according to another exemplary embodiment.

FIG. 3 is a schematic cross-sectional view of an optically-induced dielectrophoresis device according to another exemplary embodiment. Referring to FIG. 3, the optically-induced dielectrophoresis device 100*b* in this embodiment is similar to the optically-induced dielectrophoresis device 100 in FIG. 1B, and the main difference therebetween is as follows. In the optically-induced dielectrophoresis device 100*b*, the first patterned photoconductor layer 130*b* is a continuous layer having a grid-shaped recess 133*b*, and the first patterned layer 140*b* is a grid-shaped insulation layer embedded in the grid-shaped recess 133*b*. The top view of the grid shape of the grid-shaped recess 133*b* and the first patterned layer 140*b* is the same as or similar to the grid shape shown in FIG. 1A. However, in another embodiment, the first patterned photoconductor layer 130*b* may be a continuous layer having stripe-shaped recesses, and the first patterned layer 140*b* may be a stripe-shaped insulation layer embedded in the stripe-shaped recesses. The top view of the stripe shapes of the stripe-shaped recesses and the stripe-shaped insulation layer are the same or similar to the stripe shape of the first patterned layer 140*k* in FIG. 1D.

Figure 4:
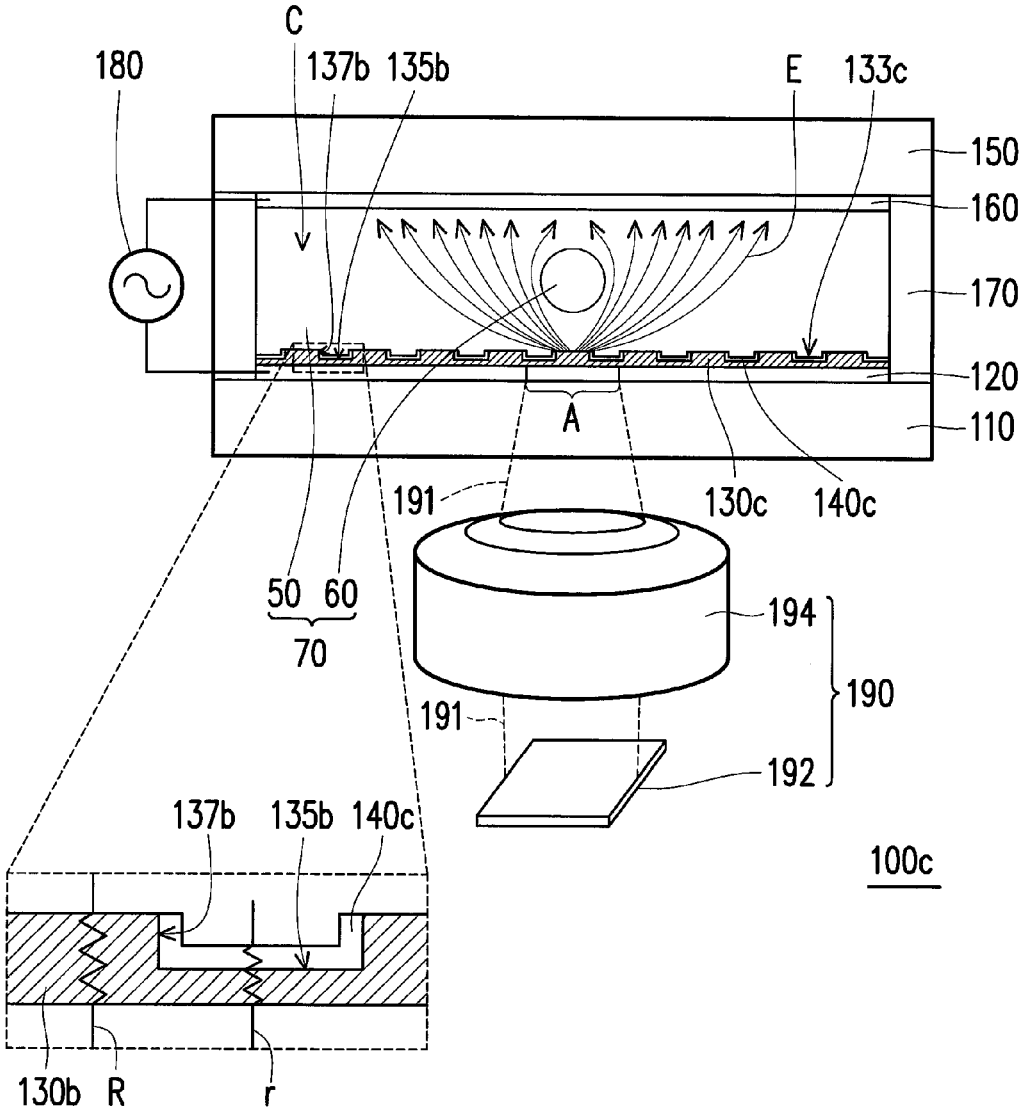
FIG. 4 is a schematic cross-sectional view of an optically-induced dielectrophoresis device according to another exemplary embodiment.

FIG. 4 is a schematic cross-sectional view of an optically-induced dielectrophoresis device according to another exemplary embodiment. Referring to FIG. 4, the optically-induced dielectrophoresis device 100*c* in this embodiment is similar to the optically-induced dielectrophoresis device 100*b* in FIG. 3, and the main difference therebetween is as follows. In the optically-induced dielectrophoresis device 100*c*, the first patterned photoconductor layer 130*c* is a continuous layer having a patterned recess 133*c*, and the first patterned layer 140*c* is a metal layer disposed inside the patterned recess 133*c*. The metal layer may be made of gold or any other metal having good conductivity. In this embodiment, the patterned recess 133*c* comprises a plurality of dot recesses separate from each other. The top view of the shape of the dot recesses is the same as or similar to the top view of the shape of the photoconductor islands 132 shown in FIG. 1A. However, in other embodiments, the patterned recess 133 may be a grid-shaped recess, and the grid shape of the grid-shaped recess is the same or similar to the grid shape of the first patterned layer 140 in FIG. 1A. Alternatively, the patterned recess 133 may comprise a plurality of stripe-shaped recesses, and the stripe shape of the stripe-shaped recesses is the same as or similar to the shape of the first patterned photoconductor layer 130*k* shown in FIG. 1D. In this embodiment, the metal layer (i.e. the first patterned layer 140*c*) is disposed on a side surface 137*b* and a bottom surface 135*b* of the patterned recess 133*c*. However, in another embodiment, the metal layer (i.e. the first patterned layer) may be disposed on the bottom surface 135*b* of the patterned recess 133*c* but not on the side surface 137*b* of the patterned recess 133*c*.

In this embodiment, the resistivity of the patterned photoconductor layer 130*c* is less than the resistivity of the first patterned layer 140*c*. Moreover, in this embodiment, the resistance of the portion of the patterned photoconductor layer 130*c* not covered by the first patterned layer 140*c* along the direction perpendicular to the first conductive layer 120 is R, and the resistance of the first patterned layer 140*c* plus the resistance of the portion of the patterned photoconductor layer 130*c* under the first patterned layer 140*c* along the direction perpendicular to the first conductive layer 120 is r as shown in the enlarged diagram in FIG. 4. Since the resistance R and the resistance r are connected in parallel, the equivalent resistance of the resistance R and the resistance r is $$\left(\frac{1}{R}+\frac{1}{r}\right)^{-1},$$

which is less than R and is less than r. As a result, the equivalent resistance of the patterned photoconductor layer 130*c* and the first patterned layer 140*c* is effectively reduced, so that the optically-induced dielectrophoresis device is adapted to medium with higher conductivity.

Figure 5:
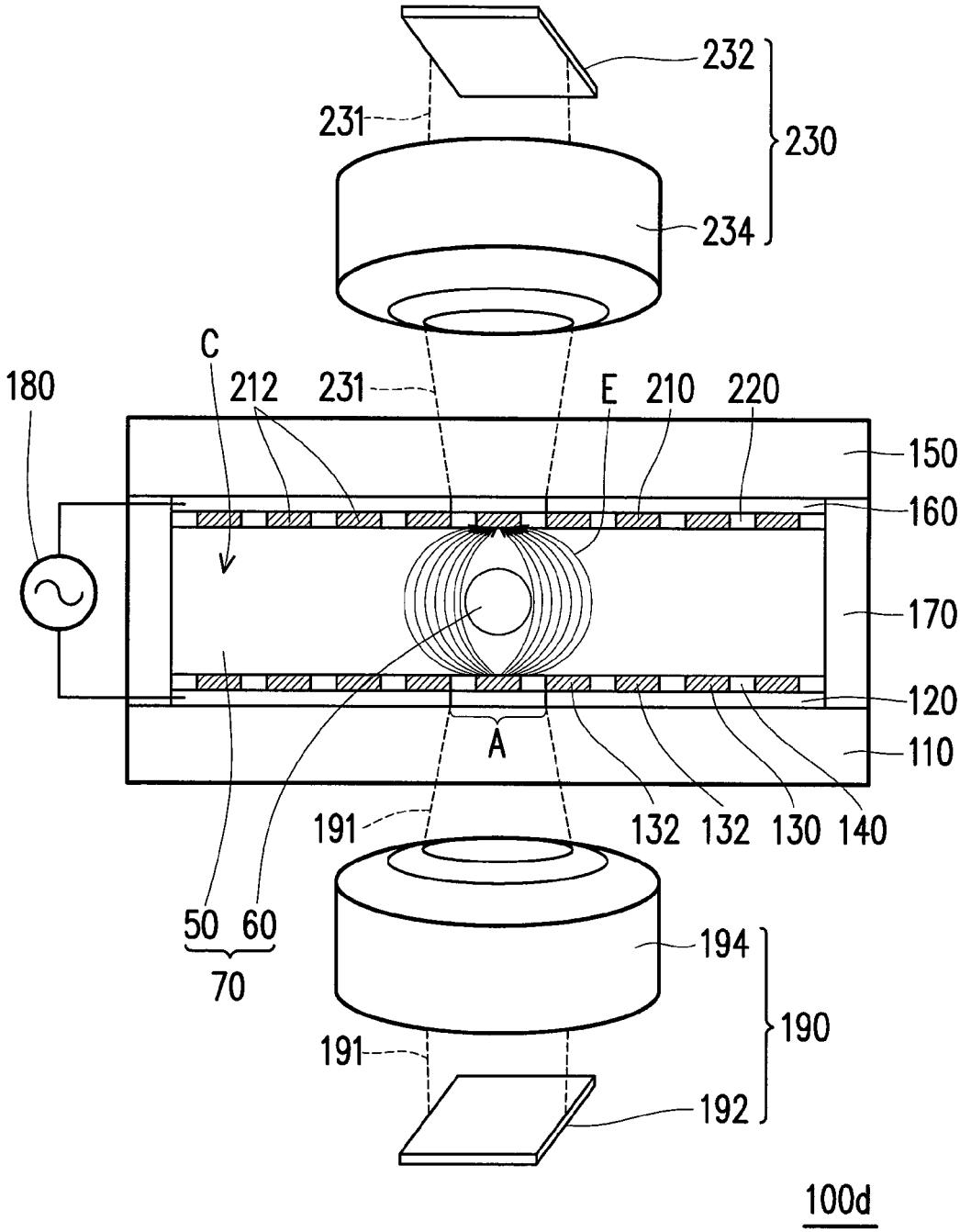
FIG. 5 is a schematic cross-sectional view of an optically-induced dielectrophoresis device according to another exemplary embodiment.

FIG. 5 is a schematic cross-sectional view of an optically-induced dielectrophoresis device according to another exemplary embodiment. Referring to FIG. 5, the optically-induced dielectrophoresis device 100*d* in this embodiment is similar to the optically-induced dielectrophoresis device 100 in FIG. 1B, and the main difference therebetween is as follows. In this embodiment, the optically-induced dielectrophoresis device 100*d* further comprises a second patterned photoconductor layer 210 and a second patterned layer 220. The second patterned photoconductor layer 210 is disposed on the second conductive layer 160, and the second patterned layer 220 is disposed on the second conductive layer 160. The second patterned photoconductor layer 210 and the second patterned layer 220 are distributed alternately over the second conductive layer 160, and resistivity of the second patterned photoconductor layer 210 is not equal to resistivity of the second patterned layer 220. The second patterned photoconductor layer 210 and the second patterned layer 220 are disposed between the second conductive layer 160 and the first patterned photoconductor layer 130. When the voltage difference is generated between the first conductive layer 120 and the second conductive layer 160 and when the light 231 irradiates a part of the second patterned photoconductor layer 210, the conductivity of the part of the second patterned photoconductor layer 210 increases. The shape and material of the second patterned photoconductor layer 210 may be the same as or similar to the shape and material of the first patterned photoconductor layer 130. For example, the second patterned photoconductor layer 210 may also comprise a plurality of photoconductor islands 212 separately from each other. The shape and material of the second patterned layer 220 may be the same as or similar to the shape and material of the first patterned layer 140.

In this embodiment, the optically-induced dielectrophoresis device 100*d* further comprises a second projector 230, and the light 231 (i.e. an image beam) is projected onto the second patterned photoconductor layer 210 from the second projector 230. The type and configuration of the second projector 230 are the same as or similar to those of the first projector 190. For example, the second projector 230 may also comprise an image source 232 and a projection lens 234. Since the optically-induced dielectrophoresis device 100*d* has both the first and second patterned photoconductor layers 130 and 210 serving as two opposite virtual electrodes, the electrical field E around the region A is stronger, and the gradient of the electrical field E around the region A is greater. As a result, the optically-induced dielectrophoresis device 100*d* can achieve better particle control.

In other embodiments, the optically-induced dielectrophoresis device 100*a* in FIG. 2 may also be modified to have a second patterned photoconductor layer the same as or similar to the first patterned photoconductor layer 130*a* but disposed on the second conductive layer 160, and have a second patterned layer the same as or similar to the first patterned layer 140*a* but disposed on the second conductive layer 160, and have a second projector the same as or similar to the first projector 190 but disposed beside the second substrate 150. The optically-induced dielectrophoresis device 100*b* in FIG. 3 may also be modified to have a second patterned photoconductor layer the same as or similar to the first patterned photoconductor layer 130*b* but disposed on the second conductive layer 160, and have a second patterned layer the same as or similar to the first patterned layer 140*b* but disposed on the second conductive layer 160, and have a second projector the same as or similar to the first projector 190 but disposed beside the second substrate 150. Moreover, the optically-induced dielectrophoresis device 100*c* in FIG. 4 may also be modified to have a second patterned photoconductor layer the same as or similar to the first patterned photoconductor layer 130*c* but disposed on the second conductive layer 160, and have a second patterned layer the same as or similar to the first patterned layer 140*c* but disposed on the second conductive layer 160, and have a second projector the same as or similar to the first projector 190 but disposed beside the second substrate 150.

Figure 6A:
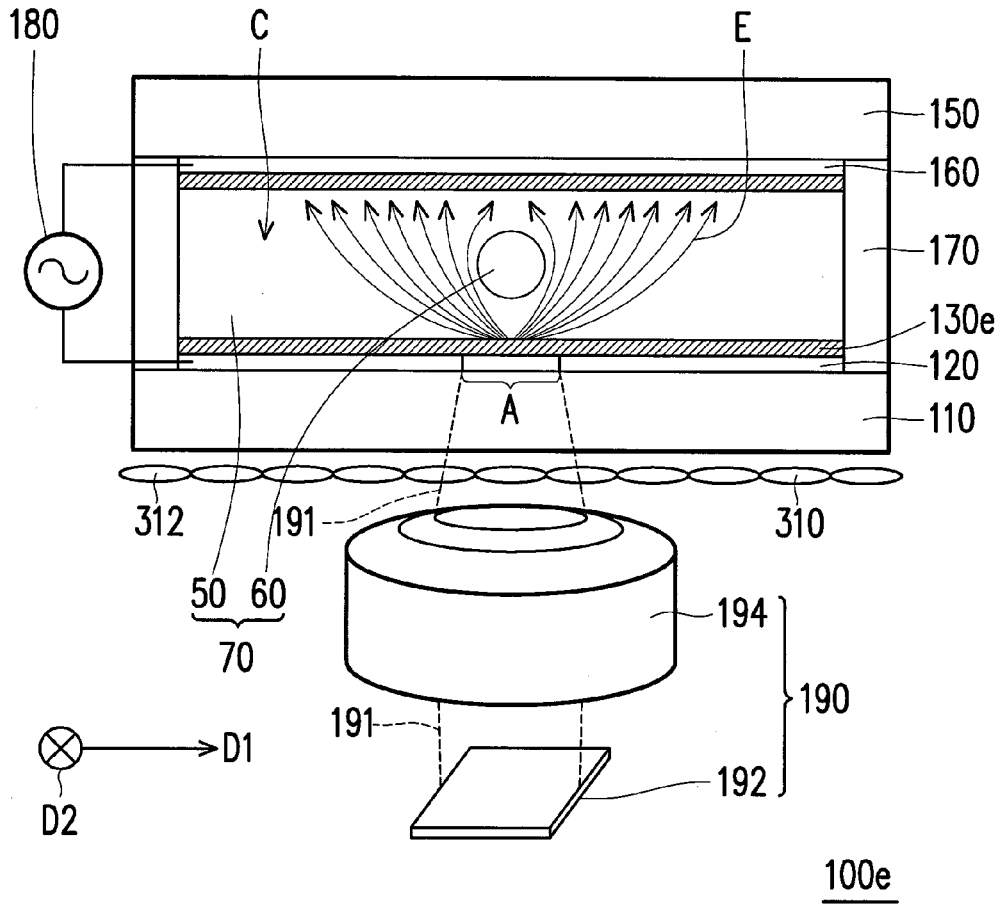
FIG. 6A is a schematic cross-sectional view of an optically-induced dielectrophoresis device according to another exemplary embodiment.
Figure 6B:
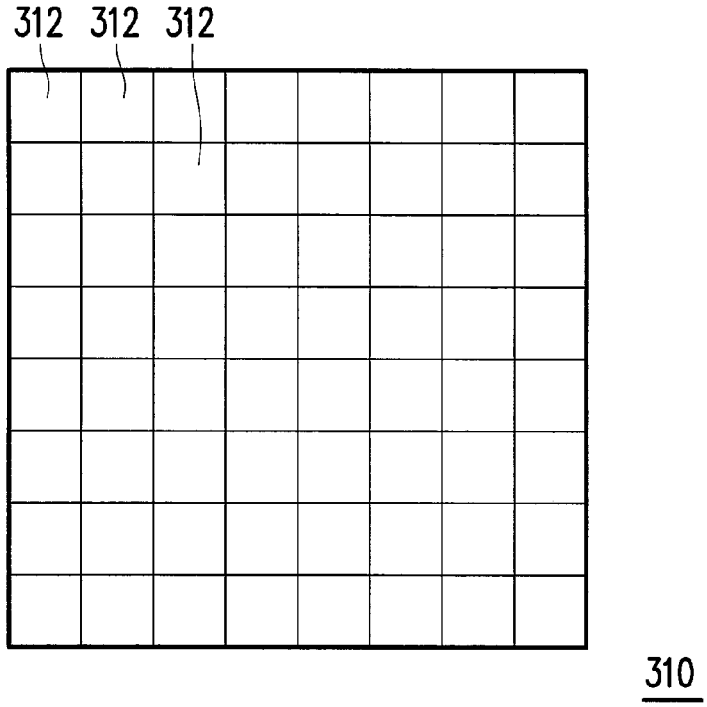
FIG. 6B is the top view of the lens array in FIG. 6A.
Figure 6C:
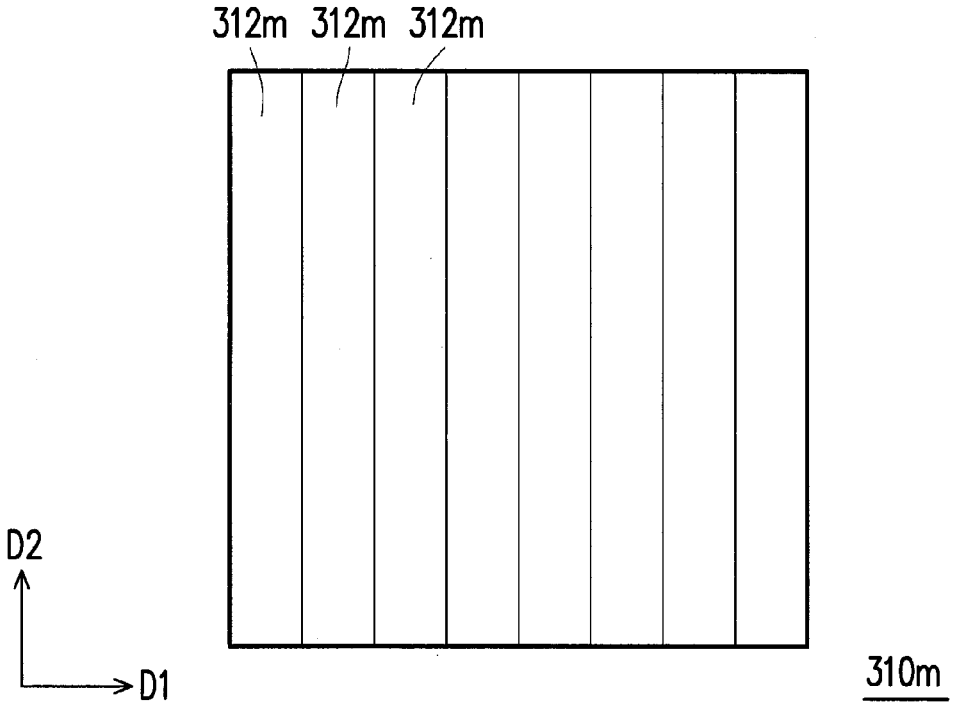
FIG. 6C is the top view of a variation of the lens array in FIG. 6A.

FIG. 6A is a schematic cross-sectional view of an optically-induced dielectrophoresis device according to another exemplary embodiment, FIG. 6B is the top view of the first lens array in FIG. 6A, and FIG. 6C is the top view of a variation of the first lens array in FIG. 6A. Referring to FIGS.

6A and 6B first, the optically-induced dielectrophoresis device 100*e* in this embodiment is similar to the optically-induced dielectrophoresis device 100 in FIG. 1B, and the main difference therebetween is as follows. In the optically-induced dielectrophoresis device 100*e*, a first photoconductor layer 130*e* disposed on the first conductive layer 120 is a continuous layer without being patterned, and the optically-induced dielectrophoresis device 100*e* does not have the first patterned layer 140 shown in FIG. 1B. However, the optically-induced dielectrophoresis device 100*e* further comprises a first lens array 310 disposed on the first substrate and configured to condense the light 191 onto the first photoconductor layer 130*e*. In this embodiment, the first lens array 310 comprises a plurality of lenses 312 arranged in a two-dimensional array, and the lenses 312 may be convex lenses. However, in another embodiment as shown in FIG. 6C, a first lens array 310*m* comprises a plurality of lenses 312*m* arranged in a one-dimensional array, and the lenses 312*m* may be lenticular lenses with convex surfaces curved in a single direction, e.g. the first direction D1. The lenses 312*m* may be arranged along the first direction D1, and each of the lenses 312*m* may extend along the second direction D2. In this embodiment, the material of the first photoconductor layer 130*e* may be the same as or similar to that of the first patterned photoconductor layer 130.

After the light 191 passes through the first lens array 310, the lenses 312 form a plurality of separate light spots onto the first photoconductor layer 130*e*, so that the portions of the first photoconductor layer 130*e* where the photoelectric effect occurs are separate from each other, which is similar to the situation of the separate photoconductor islands 132 irradiated by the light 191. As a result, the gradient of the electrical field E around the region A is enhanced, so that the optically-induced dielectrophoresis device 100*e* can achieve better particle control.

Figure 7:
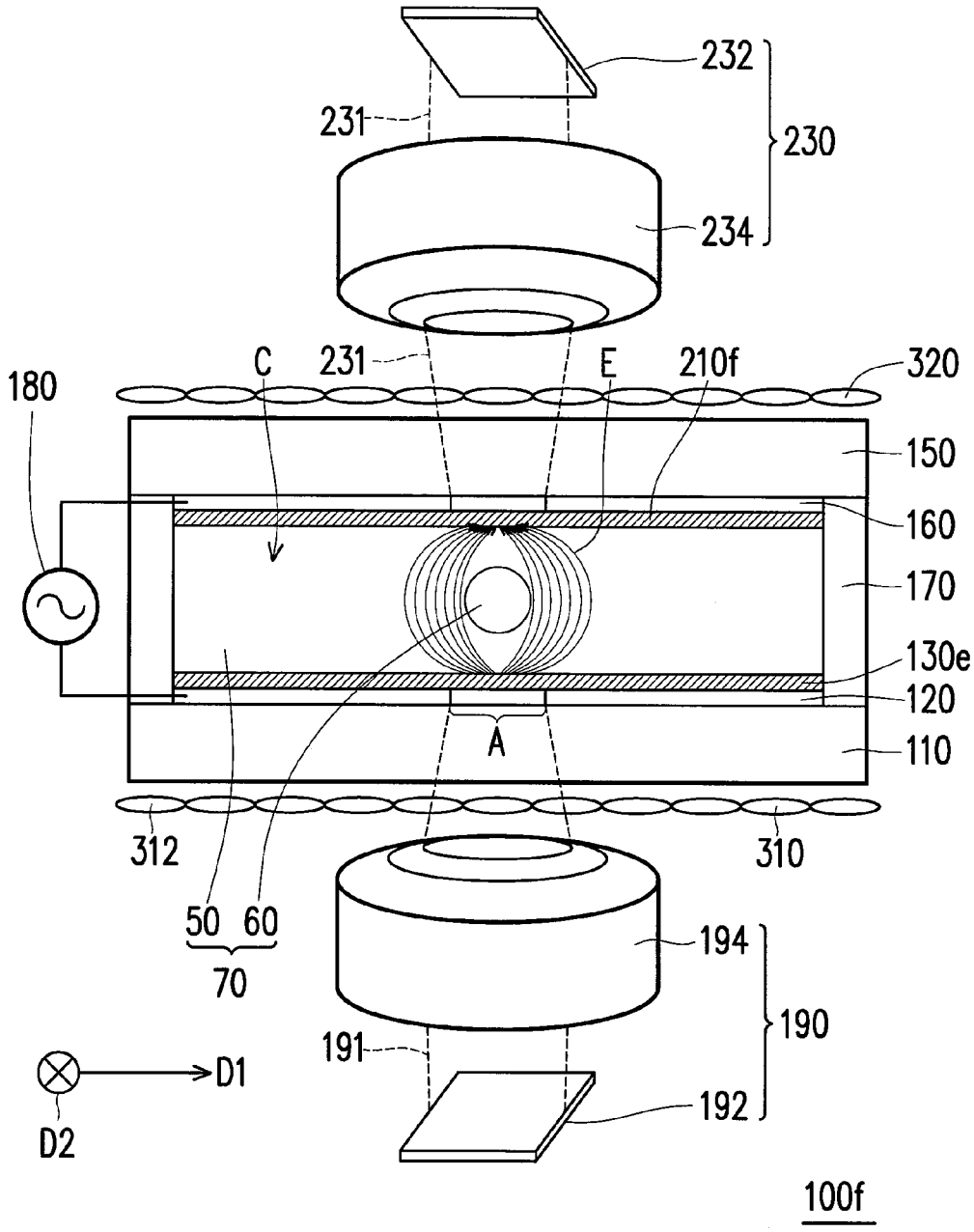
FIG. 7 is a schematic cross-sectional view of an optically-induced dielectrophoresis device according to another exemplary embodiment.

FIG. 7 is a schematic cross-sectional view of an optically-induced dielectrophoresis device according to another exemplary embodiment. Referring to FIG. 7, the optically-induced dielectrophoresis device 100*f* in this embodiment is similar to the optically-induced dielectrophoresis device 100*e* in FIG. 6A, and the main difference therebetween is as follows. The optically-induced dielectrophoresis device 100*f* in this embodiment further comprises a second photoconductor layer 210*f* and a second lens array 320. The second photoconductor layer 210*f* is disposed on the second conductive layer 160 and the second photoconductor layer 210*f* is disposed between the second conductive layer 160 and the first photoconductor layer 130*e*. The second lens array 320 is disposed on the second substrate 150 and configured to condense the light 231 onto the second photoconductor layer 210*f*. When the voltage difference is generated between the first conductive layer 120 and the second conductive layer 160 and when the light 231 irradiates a part of the second photoconductor layer 210*f*, the conductivity of the part of the second photoconductor layer 210*f* increases. The optically-induced dielectrophoresis device 100*f* also comprises the second projector 230 as shown in FIG. 5. The material of the second photoconductor layer 210*f* may be the same as or similar to that of the first photoconductor layer 130*e*.

Figure 8:
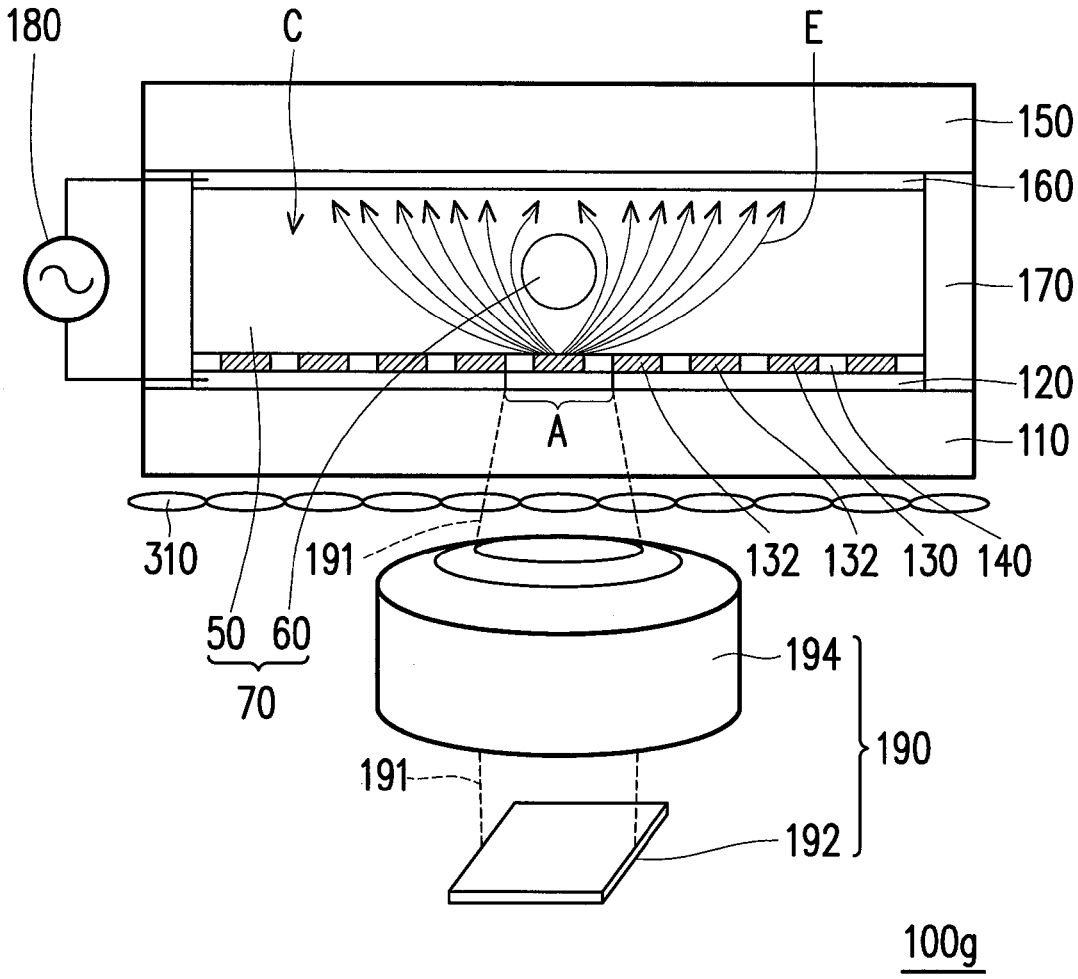
FIG. 8 is a schematic cross-sectional view of an optically-induced dielectrophoresis device according to another exemplary embodiment.

FIG. 8 is a schematic cross-sectional view of an optically-induced dielectrophoresis device according to another exemplary embodiment. Referring to FIG. 8, the optically-induced dielectrophoresis device 100*g* in this embodiment is similar to the optically-induced dielectrophoresis device 100*e* in FIG. 6A, and is similar to the optically-induced dielectrophoresis device 100 in FIG. 1B and the main difference therebetween is as follows. The optically-induced dielectrophoresis device 100*g* in FIG. 8 adopts the first lens array 310 shown in FIG. 6A and adopts the first patterned photoconductor layer 130 and the first patterned layer 140 shown in FIG. 1B. Since both the first lens array 310 and the first patterned photoconductor layer 130 increase the gradient of the electrical field E around the region, so that the optically-induced dielectrophoresis device can achieve improved particle control.

In this embodiment, the width of the gap between two adjacent photoconductor islands 132 is smaller than the pitch of the first lens array 310.

Figure 9:
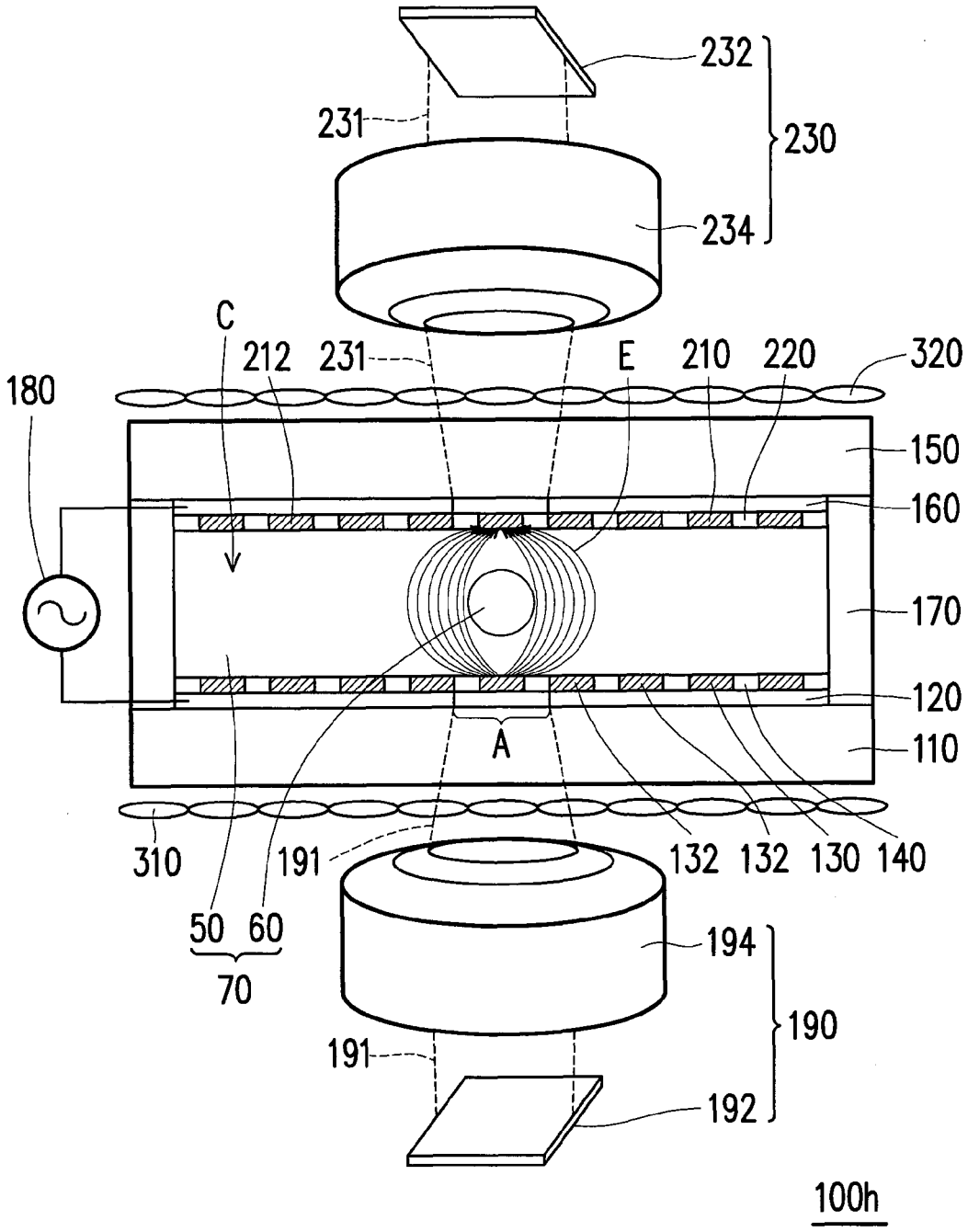
FIG. 9 is a schematic cross-sectional view of an optically-induced dielectrophoresis device according to another exemplary embodiment.

FIG. 9 is a schematic cross-sectional view of an optically-induced dielectrophoresis device according to another exemplary embodiment. Referring to FIG. 9, the optically-induced dielectrophoresis device 100*h* in this embodiment in FIG. 9 is similar to the optically-induced dielectrophoresis device 100*f* in FIG. 7, and is similar to the optically-induced dielectrophoresis device 100*d* in FIG. 5 and the main difference therebetween is as follows. The optically-induced dielectrophoresis device 100*h* adopts the first lens array 310, the second lens array 320, the first projector 190, and the second projector 230 shown in FIG. 7 and adopts the first patterned photoconductor layer 130, the first patterned layer 140, the second patterned photoconductor layer 210, and the second patterned layer 220 shown in FIG. 5.

Figure 10A:
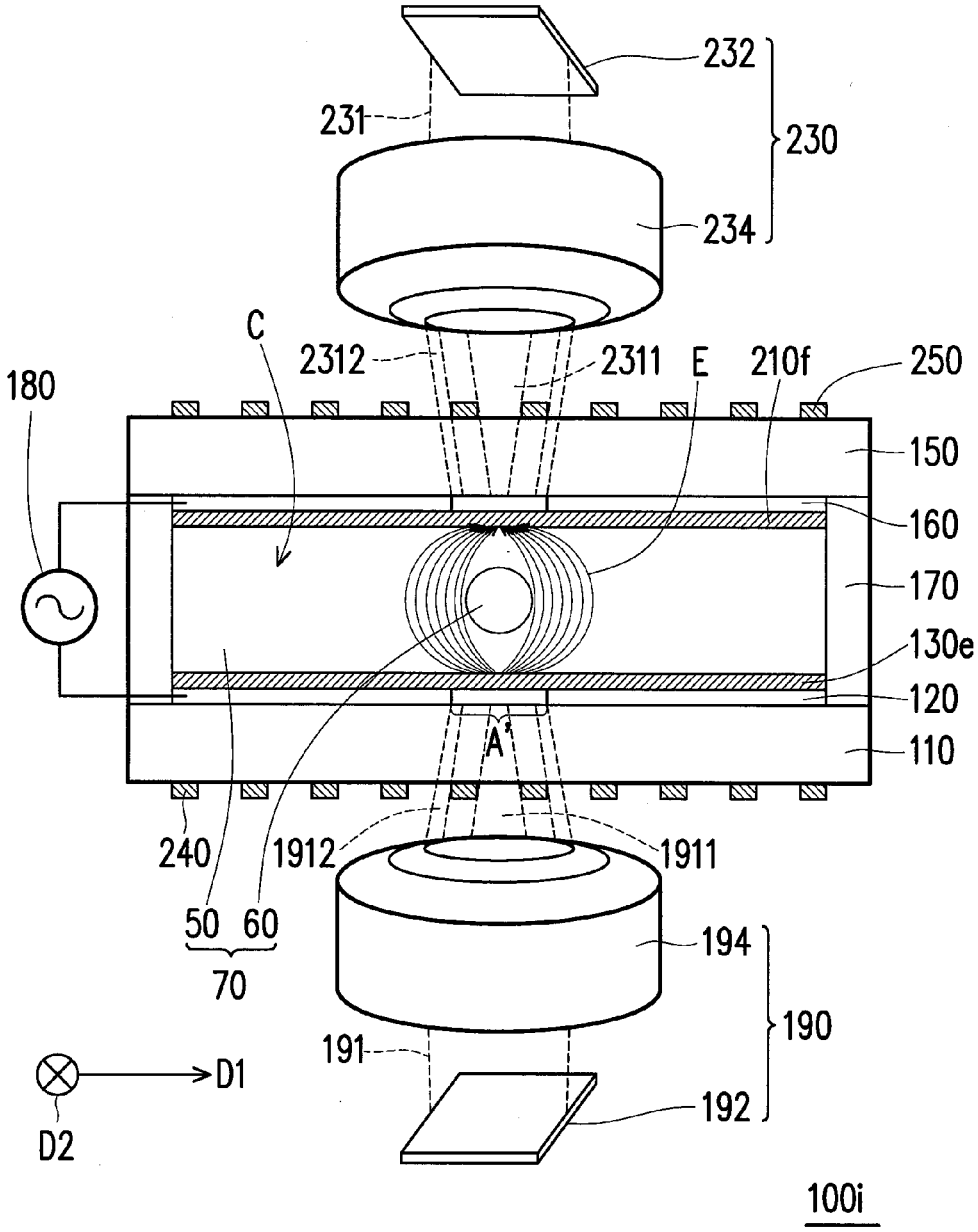
FIG. 10A is a schematic cross-sectional view of an optically-induced dielectrophoresis device according to another exemplary embodiment.
Figure 10B:
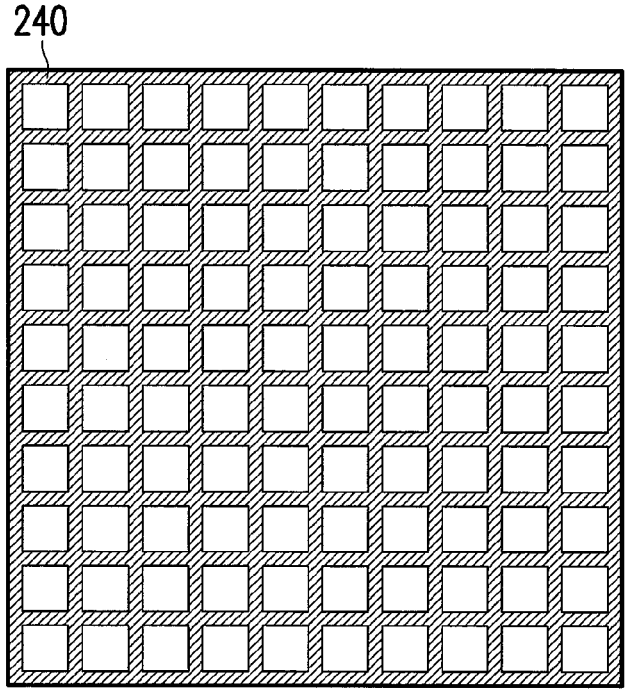
FIG. 10B is a top view of the first patterned mask in FIG. 10A.
Figure 10C:
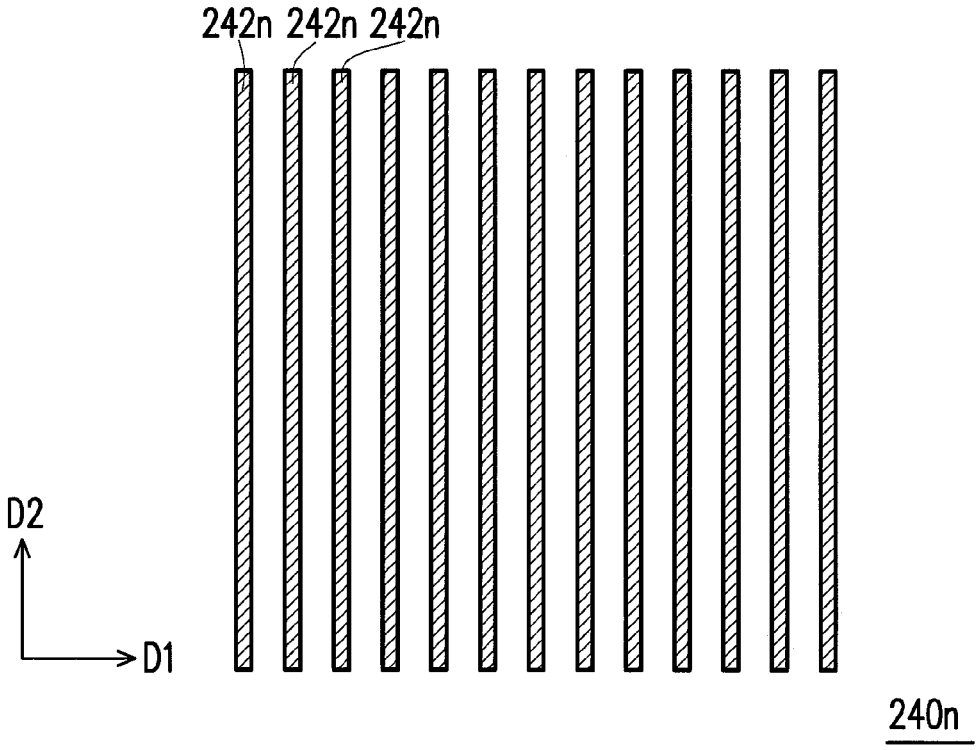
FIG. 10C is a top view of a variation of the first patterned mask shown in FIG. 10B.
Figure 10D:
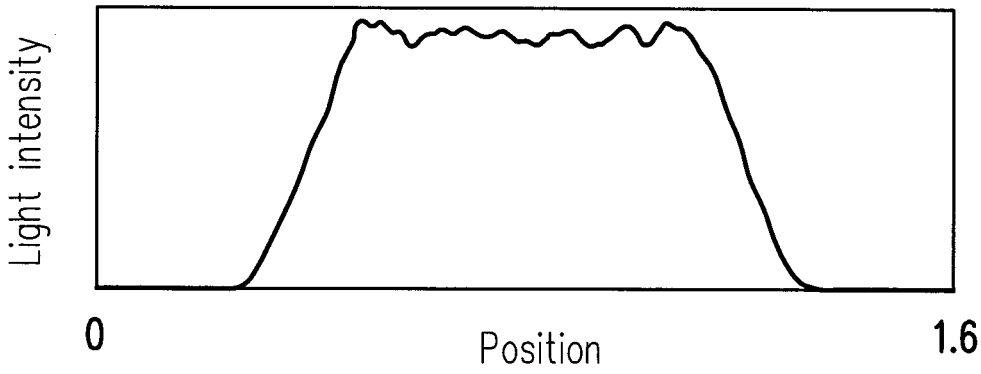
FIG. 10D shows the light intensity distribution formed by a light on a continuous photoconductor layer without being shielded by the first patterned mask shown in FIG. 10A.
Figure 10E:
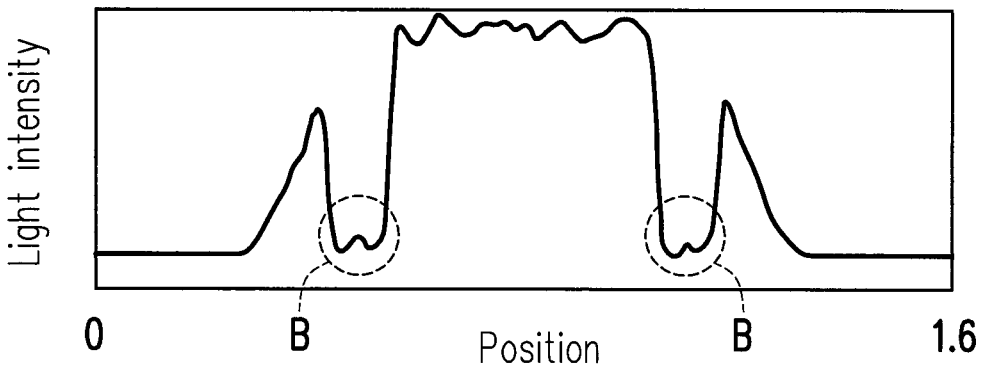
FIG. 10E shows the light intensity distribution formed by the light on the first photoconductor layer in FIG. 10A.

FIG. 10A is a schematic cross-sectional view of an optically-induced dielectrophoresis device according to another exemplary embodiment, FIG. 10B is a top view of the first patterned mask in FIG. 10A, FIG. 10C is a top view of a variation of the first patterned mask shown in FIG. 10B, FIG. 10D shows the light intensity distribution formed by a light on a continuous photoconductor layer without being shielded by the first patterned mask shown in FIG. 10A, and FIG. 10E shows the light intensity distribution formed by the light on the first photoconductor layer in FIG. 10A. Referring to FIGS. 10A to 10E first, the optically-induced dielectrophoresis device 100*i* in this embodiment is similar to the optically-induced dielectrophoresis device 100*f* in FIG. 7, and the main difference therebetween is as follows. In the optically-induced dielectrophoresis device 100*i*, the first lens array 310 and the second lens array 320 are respectively replaced by a first patterned mask 240 and a second patterned mask 250. The first patterned mask 240 is disposed on the first substrate 110 and configured to shield a part of the light 191, and the second patterned mask 250 is disposed on the second substrate 150 and configured to shield a part of the light 231. Specifically, the part 1911 of the light 191 is shield by the first patterned mask 240, and the part 1912 of the light 191 passes through the first patterned mask 240 to irradiate the first photoconductor layer 130*e*. Moreover, the part 2311 of the light 231 is shield by the second patterned mask 250, and the part 2312 of the light 231 passes through the second patterned mask 250 to irradiate the second photoconductor layer 210*f*. In this embodiment, the first patterned mask 240 is grid-shaped as shown in FIG. 10B. However, in another embodiment, the first patterned mask 240*n* may be stripe-shaped. Specifically, the first patterned mask 240*n* may comprise a plurality of shielding strips 242*n* arranged along the first direction D1 and extending along the second direction D2. Moreover, the second patterned mask 250 may be grid-shaped as shown in FIG. 10B or stripe-shaped as shown in FIG. 10C.

When the first patterned mask 240 is not used, the light distribution formed by the light 191 on the first photoconductor layer 130*e* along the first direction D1 is as shown in FIG. 10D. In this embodiment, the light distribution formed by the light 191 on the first photoconductor layer 130*e* along the first direction D1 is as shown in FIG. 10E. The recessed portions B of the light distribution in FIG. 10E are caused by the first patterned mask 240 shielding the part 1911 of the light 191. As a result, the slope of the light intensity around the recessed portion B in FIG. 10E is greater than the slope of the light intensity distribution in FIG. 10D at two opposite sides. Therefore, the light intensity distribution in FIG. 10E can cause greater gradient of the electrical field E around the region A' irradiated by the light 191, so that the optically-induced dielectrophoresis device 100*i* in this embedment can achieve better particle control.

In another embodiment, the second patterned mask 250, the second photoconductor layer 210*f*, and the second projector 230 are not used.

In this embodiment, the first patterned mask 240 is disposed on the surface of the first substrate 110 facing away from the first conductive layer 120. However, in another embodiment, the first patterned mask 240 may be disposed between the first conductive layer 120 and the first substrate 110 or between the first conductive layer 120 and the first photoconductor layer 130*e*. In this embodiment, the second patterned mask 250 is disposed on the surface of the second substrate 150 facing away from the second conductive layer 160. However, in another embodiment, the second patterned mask 250 may be disposed between the second conductive layer 160 and the second substrate 150 or between the second conductive layer 160 and the second photoconductor layer 210*f*.

Figure 11:
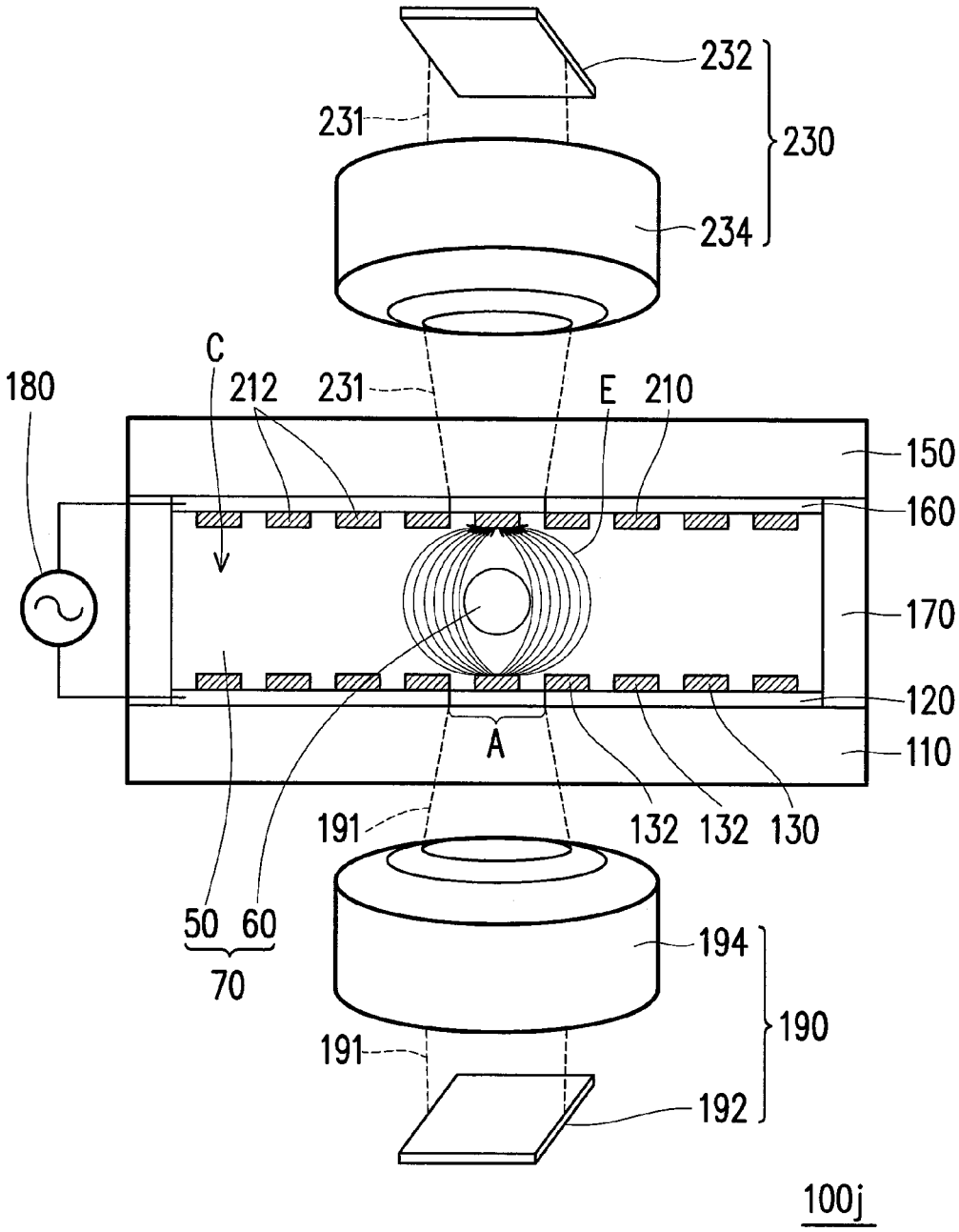
FIG. 11 is a schematic cross-sectional view of an optically-induced dielectrophoresis device according to another exemplary embodiment.

FIG. 11 is a schematic cross-sectional view of an optically-induced dielectrophoresis device according to another exemplary embodiment. Referring to FIG. 11, the optically-induced dielectrophoresis device 100*j* in this embodiment is similar to the optically-induced dielectrophoresis device 100*d* in FIG. 5, and the main difference therebetween is as follows. In this embodiment, the optically-induced dielectrophoresis device 100*j* does not have the first patterned layer 140 and the second patterned layer 220 in FIG. 5. Moreover, the first patterned photoconductor layer 130 is in direct contact with the first conductive layer 120, and the second patterned photoconductor layer 210 is in direct contact with the second conductive layer 160. When the conductivity of the sample 70 is low, the sample 70 filled in the gap between two adjacent photoconductor islands 132 resembles an insulator like the first patterned layer shown in FIG. 1B. As a result, the gradient of the electrical field E is increased, so that the optically-induced dielectrophoresis device 100*j* may also achieve good particle control.

In another embodiment, the second patterned photoconductor layer 210 and the second projector 230 may be removed from FIG. 11.

Figure 12:
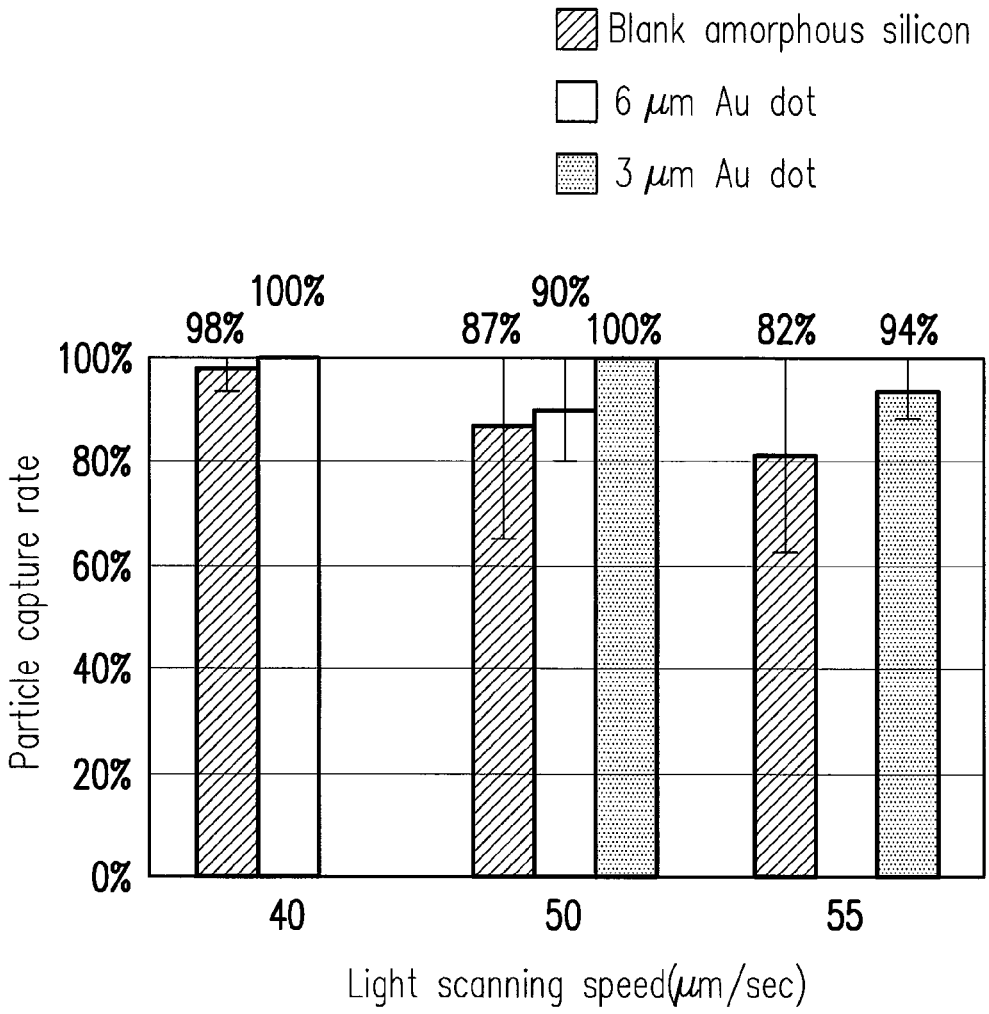
FIG. 12 shows the particle capture rates of the optically-induced dielectrophoresis device in FIG. 4 and an optically-induced dielectrophoresis device having a continuous and even photoconductor layer and not having a lens array or a patterned mask.

FIG. 12 shows the particle capture rates of the optically-induced dielectrophoresis device in FIG. 4 and an optically-induced dielectrophoresis device having a continuous and even photoconductor layer and not having a lens array or a patterned mask. Referring to FIGS. 4 and 12, the light scanning speed in FIG. 12 means the moving speed of the region A. The particle capture rate in FIG. 12 means the percentage of the particles 60 successfully moving with the movement of the region A. The blank amorphous silicon means the data obtained from an optically-induced dielectrophoresis device having a continuous and even photoconductor layer and not having a lens array or a patterned mask. The 6 μm Au dot means the data obtained from the optically-induced dielectrophoresis device 100*c* in FIG. 4 having the first patterned layer 140*c* made of gold (Au) inside the dot recesses having the width of 6 μm. The 3 μm Au dot means the data obtained from the optically-induced dielectrophoresis device 100*c* in FIG. 4 having the first patterned layer 140*c* made of gold (Au) inside the dot recesses having the width of 3 μm. It can be known from FIG. 12 that the optically-induced dielectrophoresis device 100*c* in FIG. 4 has a better particle capture rate that that of the optically-induced dielectrophoresis device having a continuous and even photoconductor layer and not having a lens array or a patterned mask.

At least parts of the above embodiments (shown in FIGS. 1A to 11) may be combined in various ways to form various other embodiments.

In conclusion, since the optically-induced dielectrophoresis device according to the exemplary embodiments has a patterned photoconductor layer, a lens array, or a patterned mask, the gradient of the electrical field around the region irradiated by the light is increased. As a result, the optically-induced dielectrophoresis device achieves good particle control.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. An optically-induced dielectrophoresis device comprising:

a first substrate;

a first conductive layer disposed on the first substrate;

a first patterned photoconductor layer having a patterned recess, the first patterned photoconductor layer disposed on the first conductive layer;

a first patterned layer disposed on the first conductive layer, wherein the first patterned layer is a metal layer disposed inside the patterned recess of the first patterned photoconductor layer, the first patterned photoconductor layer and the first patterned layer are distributed alternately over the first conductive layer, and resistivity of the first patterned photoconductor layer is not equal to resistivity of the first patterned layer;

a second substrate, wherein at least one of the first substrate and the second substrate is pervious to a light;

a second conductive layer disposed on the second substrate and between the first substrate and the second substrate, wherein when a voltage difference is generated between the first conductive layer and the second conductive layer and when the light irradiates a part of the first patterned photoconductor layer, conductivity of the part of the first patterned photo conductor layer increases; and a spacer connecting the first substrate and the second substrate, wherein a containing space is formed between the first substrate and the second substrate.

2. The optically-induced dielectrophoresis device according to claim 1, wherein the first patterned photoconductor layer comprises a plurality of photoconductor islands separately distributed over the first conductive layer; and the first patterned layer is a grid-shaped insulation layer separating the photoconductor islands from each other.

3. The optically-induced dielectrophoresis device according to claim 1, wherein the first patterned photoconductor layer is a continuous layer having a grid-shaped recess or stripe-shaped recesses, and the first patterned layer is a grid-shaped or stripe-shaped insulation layer embedded in the grid-shaped recess or the stripe-shaped recesses.

4. The optically-induced dielectrophoresis device according to claim 1, wherein the metal layer is disposed on a bottom surface of the patterned recess.

5. The optically-induced dielectrophoresis device according to claim 1, wherein the metal layer is disposed on a side surface and a bottom surface of the patterned recess.

6. The optically-induced dielectrophoresis device according to claim 1 further comprising a first projector, wherein the light is an image beam projected from the first projector.

7. The optically-induced dielectrophoresis device according to claim 1, wherein the first patterned photoconductor layer comprises a plurality of photoconductor stripes, the first patterned layer comprises a plurality of stripe-shaped structures, the photoconductor stripes and the stripe-shaped structures are arranged alternately along a first direction, and the photoconductor stripes and the stripe-shaped structures extend along a second direction.

8. The optically-induced dielectrophoresis device according to claim 1 further comprising:

a second patterned photoconductor layer disposed on the second conductive layer; and a second patterned layer disposed on the second conductive layer, wherein the second patterned photoconductor layer and the second patterned layer are distributed alternately over the second conductive layer, resistivity of the second patterned photoconductor layer is not equal to resistivity of the second patterned layer, the second patterned photoconductor layer and the second patterned layer are disposed between the second conductive layer and the first patterned photoconductor layer, and wherein when the voltage difference is generated between the first conductive layer and the second conductive layer and when the light irradiates a part of the second patterned photoconductor layer, conductivity of the part of the second patterned photoconductor layer increases.

9. The optically-induced dielectrophoresis device according to claim 8, wherein the second patterned photoconductor layer comprises a plurality of photoconductor islands separately distributed over the second conductive layer; and the second patterned layer is a grid-shaped insulation layer separating the photoconductor islands from each other.

10. The optically-induced dielectrophoresis device according to claim 8, wherein the second patterned photoconductor layer is a continuous layer having a grid-shaped recess or stripe-shaped recesses, and the second patterned layer is a grid-shaped or stripe-shaped insulation layer embedded in the grid-shaped recess or the stripe-shaped recesses.

11. The optically-induced dielectrophoresis device according to claim 8, wherein the second patterned photoconductor layer has a patterned recess, and the second patterned layer is a metal layer disposed inside the patterned recess.

12. The optically-induced dielectrophoresis device according to claim 11, wherein the metal layer is disposed on a bottom surface of the patterned recess.

13. The optically-induced dielectrophoresis device according to claim 11, wherein the metal layer is disposed on a side surface and a bottom surface of the patterned recess.

14. The optically-induced dielectrophoresis device according to claim 8 further comprising a first projector and a second projector, wherein the light comprises a first image beam and a second image beam, the first image beam is projected onto the first patterned photoconductor layer from the first projector, and the second image beam is projected onto the second patterned photoconductor layer from the second projector.

15. The optically-induced dielectrophoresis device according to claim 8, wherein the second patterned photoconductor layer comprises a plurality of photoconductor stripes, the second patterned layer comprises a plurality of stripe-shaped structures, the photoconductor stripes and the stripe-shaped structures are arranged alternately along a first direction, and the photoconductor stripes and the stripe-shaped structures extend along a second direction.

16. The optically-induced dielectrophoresis device according to claim 1 further comprising a lens array disposed on the first substrate, wherein the first substrate is pervious to the light, and the lens array is configured to condense the light onto the first patterned photoconductor layer.

* * * * *